US006189227B1

(12) United States Patent
Siegfried

(10) Patent No.: US 6,189,227 B1
(45) Date of Patent: Feb. 20, 2001

(54) STRAIGHT LINE SHINGLE

(76) Inventor: Todd A. Siegfried, 20 Hunkey Hollow Rd., Duncannon, PA (US) 17020

( * ) Notice: Under 35 U.S.C. 154(b), the term of this patent shall be extended for 0 days.

(21) Appl. No.: 09/207,139

(22) Filed: Dec. 8, 1998

(51) Int. Cl.[7] ..... G01D 21/00

(52) U.S. Cl. ..... 33/649; 33/648; 33/645; 33/646; 33/647; 33/613

(58) Field of Search ..... 33/649, 648, 645, 33/646, 647, 613

(56) References Cited

U.S. PATENT DOCUMENTS

| | | | | |
|---|---|---|---|---|
| 239,762 | * | 4/1881 | Gay | 33/646 |
| D. 335,461 | | 5/1993 | Horsley, Jr. | D10/64 |
| 1,137,619 | * | 4/1915 | Higgins | 33/648 |
| 1,256,192 | * | 2/1918 | Aksdal | 33/649 |
| 1,380,485 | * | 6/1921 | Langeberg | 33/649 |
| 1,414,556 | * | 5/1922 | Dresen | 33/649 |
| 1,586,946 | * | 6/1926 | Carr | 33/649 |
| 1,941,404 | * | 12/1933 | Lansing | 33/648 |
| 1,954,213 | * | 4/1934 | Leonard | 33/648 |
| 3,792,852 | * | 2/1974 | Reniker | 33/648 |
| 4,056,889 | | 11/1977 | Barnett, III | 33/188 |
| 4,110,911 | | 9/1978 | Sucheck | 33/188 |
| 4,285,134 | * | 8/1981 | Schmanski | 33/649 |
| 5,018,279 | | 5/1991 | Williams | 33/649 |
| 5,081,815 | * | 1/1992 | Carnell | 53/747 |
| 5,107,600 | * | 4/1992 | Riesberg | 33/645 |
| 5,197,257 | * | 3/1993 | Nietling | 33/648 |
| 5,311,670 | | 5/1994 | Tomoiaga | 33/648 |
| 5,918,439 | * | 7/1999 | Metzer et al. | 33/649 |

* cited by examiner

*Primary Examiner*—G. Bradley Bennett
*Assistant Examiner*—Gail Verbitsky
(74) *Attorney, Agent, or Firm*—Foley & Lardner

(57) ABSTRACT

An apparatus for applying shingles onto a roof of a structure. The apparatus includes a first and second retractable/extendable rail, with the first and second rails being positioned to ends of a roof in a parallel relationship to each other. The first and second rails are configured with slots positioned approximately 5" apart from each other. The apparatus also includes a third retractable/extendable rail, which is positioned in corresponding opposing slots in the first and second rails. A fourth and a fifth rail are hingedly connected to the third rail, with the fourth rail having a bottom portion for resting shingles against as they are placed in proper locations on the roof.

10 Claims, 10 Drawing Sheets

STRAIGHT LINE SHINGLE

BACKGROUND OF THE INVENTION

1. Field of the Invention

The invention relates to an apparatus for placing shingles onto a roof in an orderly manner. In particular, the invention relates to an apparatus that allows for quick and accurate placement of shingles onto a roof of a structure, such as a house.

2. Description of the Related Art

During construction of a house or other type of structure, once the frame of the house has been constructed, the roof can then be installed. Typically, this involves the placement of shingles onto the roof frame, in a standard manner so as to allow for rain or other precipitation to flow off of the roof and onto a drainage system (i.e., drain spouts on the side of the house). Using conventional methods, the placement of shingles onto the roof is a time-consuming and error-prone effort, in which typically a group of persons work together to first place the shingles onto the roof in rows, and then staple the shingles in place. When one row is complete, the workers move onto a next row to continue the process.

For standard roofs, the rows are placed 5" apart from each other, with the first row placed approximately 11½" from the edge of the roof. After the placement of the first row, shingles of the second row are shifted 6" with respect to the shingles of the first row, shingles of the third row are shifted 6" with respect to the shingles of the second row (and are thus in alignment with the shingles of the first row), and so on. By this arrangement, the shingles overlap each other, as well as having a lattice-like appearance when placed onto the roof.

There are several conventional apparatuses that have been developed to assist roofers in the proper placement of shingles onto a residential or commercial structure. One such apparatus is disclosed by L. Barnett III, in a patent entitled "Strip Shingle Alignment Fixtures", U.S. Pat. No. 4,056,889. Barnett's apparatus allows for the alignment of strip shingles for roofing and siding, in which an elongated alignment guide is provided for supporting the lower edges of the shingles to be laid on the roof. The alignment guide includes several sections, some equal in length to two standard strip shingles, and others equal in length to one standard strip shingle. FIG. 1 shows Barnett's apparatus, with a lip provided for laying the shingles along a row in an accurate manner.

Another such conventional shingle application apparatus is disclosed by R. Sucheck, in a patent entitled "Shingle Gage", U.S. Pat. No. 4,110,911. Sucheck discloses a shingle gage that allows for alignment of a second row of shingles onto a first row of shingles that have been fixed to a roof of a structure. The shingle gage includes a first member having a first alignment surface which abuts one longitudinal edge of the fixed row of shingles, and a second member attached to the first member and which includes a second alignment surface adapted to abut against one longitudinal edge of the second row of shingles. Such an apparatus is shown in FIGS. 2 and 3, with FIG. 2 shows the apparatus 10 on a roof having shingles 50, and with FIG. 3 showing the first member 12 and the second member 14. With this apparatus, the first member 12 and the second member 14 are threadably engaged by nuts so that the members are substantially parallel but spaced apart from each other. Once this is done, a strip of shingles for a second row of shingles can be placed in alignment with already-attached shingles corresponding to a first row of shingles.

U.S. Pat. No. Des. 335,461, issued to H. Horsley, Jr., discloses a design of a straight edge for aligning a shingle onto a roof. Such a device is shown as element 80 in FIG. 4.

U.S. Pat. No. 5,018,279, issued to C. Williams, discloses a strip shingle alignment tool 70, as seen in FIG. 5. The tool 70 is used to position square tab shingles on a roof surface in alignment with shingle strips already fastened to the roof. The tool 70 includes a long straight shingle positioning plate having a base flange extending a right angles up away from the base flange. The tool 70 also includes two clamps that extend back from the base flange, with each clamp having a upper jaw mounted to the positioning plate and a lower jaw pivoted to the upper jaw. FIG. 6 shows the tool 70 mounted on a roof.

U.S. Pat. No. 5,311,670, issued to I. Tomoiaga, discloses a shingle alignment tool 12 for use by a single installer for aligning a row of shingles to be fastened to a roof. The alignment tool 12 is shown in FIG. 7, and includes a pair of brackets that fit snugly against the lower edge of an already-fastened shingle. The tool also includes an upper edge that allows the shingles to be fastened to be quickly placed thereagainst for proper alignment.

With each of the conventional devices described above, there exist several problems in that these devices need to be aligned with an already-fastened row of shingles to be able to work properly. Also, these devices do not allow for the application of an entire row of shingles, but only allow for a portion of a row to be installed. Once the portion of the row has been installed, the devices must be dismounted and/or moved to another location to continue the placement of the next row of shingles onto the roof.

SUMMARY OF THE INVENTION

It is an object of the invention to provide a device for placing shingles onto a roof in an efficient and accurate manner.

It is another object of the invention to provide a device for aligning shingles on a particular row on a roof, and for moving those shingles to a predetermined location with respect to other rows of shingles on the roof.

It is still another object of the invention to provide a device for applying shingles in an efficient and accurate manner onto valley portions of a roof, as well as different sizes of roofs.

These and other objects are achieved by an apparatus for applying shingles onto a roof of a structure. The apparatus includes a first retractable and expandable (extendable) pole (rail) having markings at predetermined intervals on the pole, the markings being indicative of optimal placement of rows of shingles onto the roof. The apparatus also includes a second retractable and expandable (extendable) pole (rail) opposite the first retractable and expandable (extendable) pole, the second retractable and expandable (extendable) pole also having markings that are indicative of the optimal placement of the rows of shingles onto the roof. The first and second poles are vertically disposed with respect to each other. The apparatus further includes a third retractable and expandable (extendable) pole (rail) hingedly or roller-bearingly connected to the first pole (rail) at a first end of the third pole, and hingedly connected to the second pole at a second end of the third pole. The third pole is disposed approximately perpendicular to the first and second poles. The apparatus also includes means for moving the third pole to any one of the markings on the first and second poles. The apparatus further includes a fourth pole (rail) that is positioned approximately parallel to the third pole, the fourth pole having a curved lip portion for holding one of the rows of shingles as they are placed onto the roof. The apparatus still further includes a fifth pole (rail) that is positioned approximately parallel to the third and fourth poles, with the third pole positioned between the fourth and fifth poles. The apparatus also includes means for slidably connecting the fourth and fifth poles to the third pole, so that the fourth and fifth poles can be moved along a direction perpendicular to the first and second poles so as to move the one row of shingles in the direction perpendicular to the first and second poles. The third, fourth and fifth poles are preferably disposed as a single rack.

BRIEF DESCRIPTION OF THE DRAWINGS

These and other objects and advantages of the invention will become more fully apparent from the following detailed description when read in conjunction with the accompanying drawings with like reference numerals indicating corresponding parts throughout, and wherein.

DETAILED DESCRIPTION OF THE PREFERRED EMBODIMENTS

Figure 1:
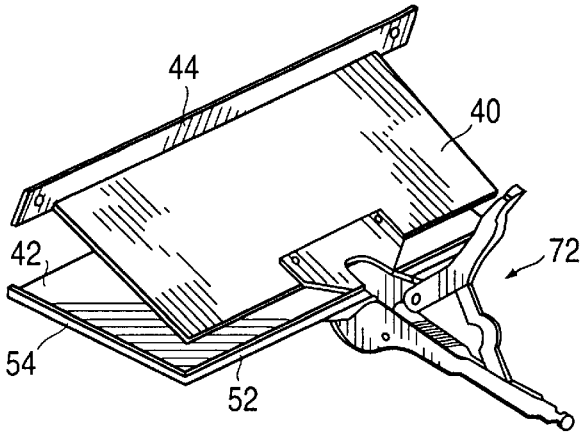
FIG. 1 (PRIOR ART)
FIG. 1 illustrates a conventional apparatus for attaching shingles onto a roof of a structure.
Figure 2:
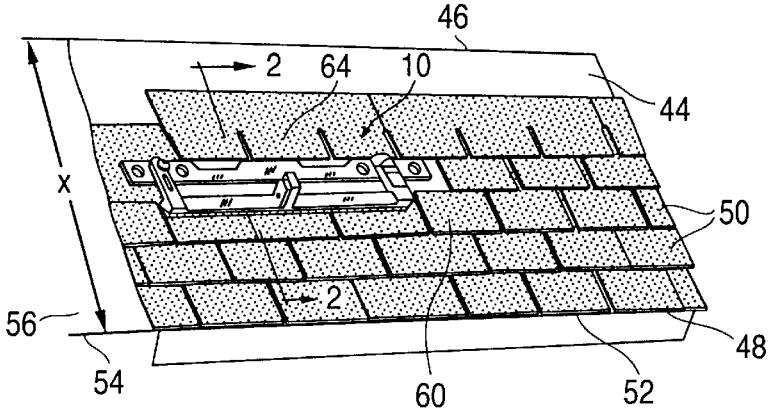
FIG. 2 (PRIOR ART)
FIG. 2 illustrates another conventional apparatus for attaching shingles onto a roof of a structure.
Figure 3:
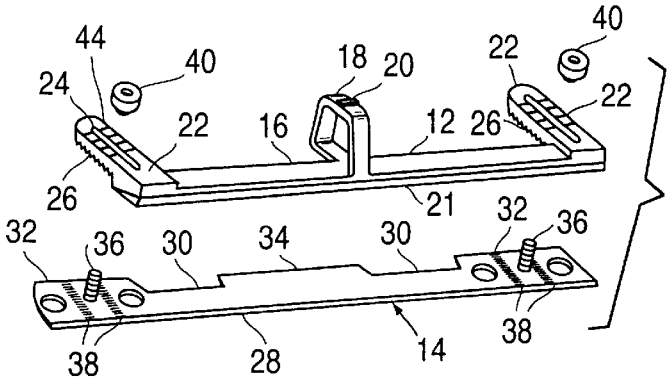
FIG. 3 (PRIOR ART)
FIG. 3 illustrates the conventional apparatus of FIG. 2 in more detail.
Figure 4:
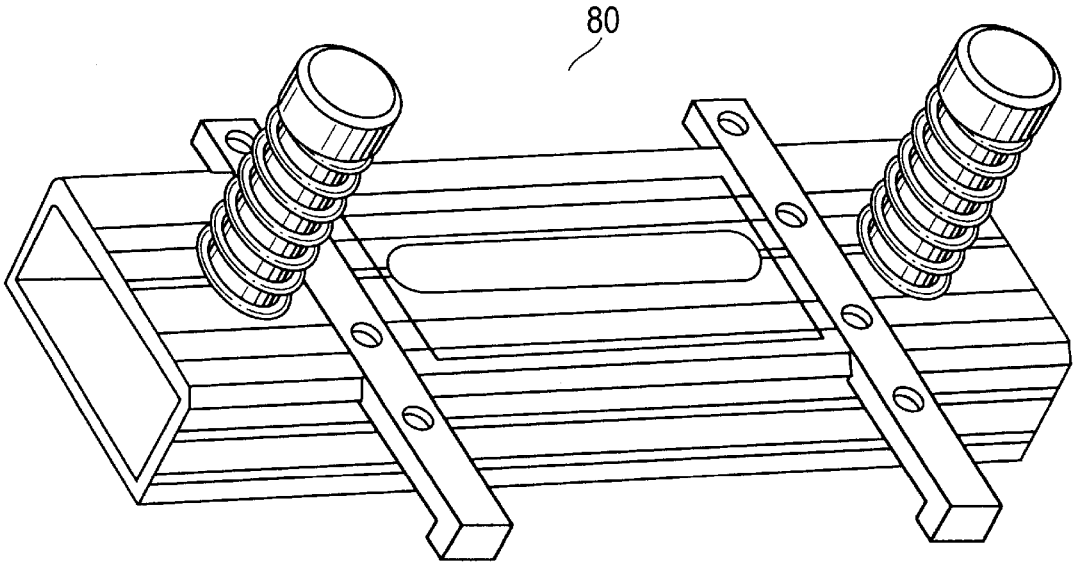
FIG. 4 (PRIOR ART)
FIG. 4 illustrates yet another conventional apparatus for attaching shingles onto a roof of a structure.
Figure 5:
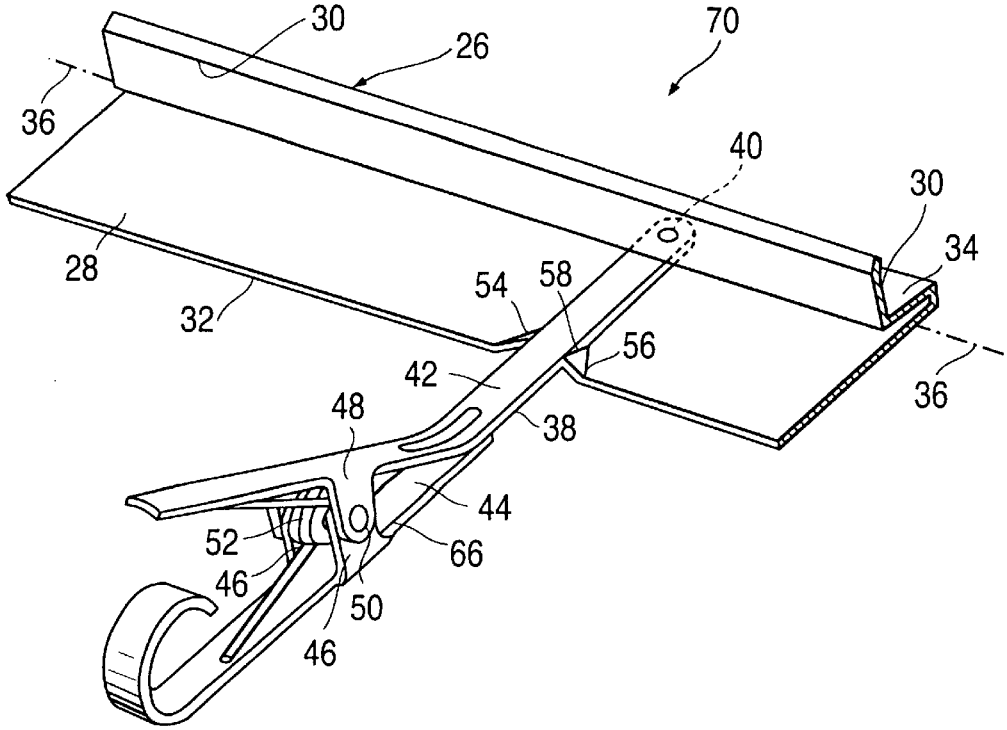
FIG. 5 (PRIOR ART)
FIG. 5 illustrates still another conventional apparatus for attaching shingles onto a roof of a structure.
Figure 6:
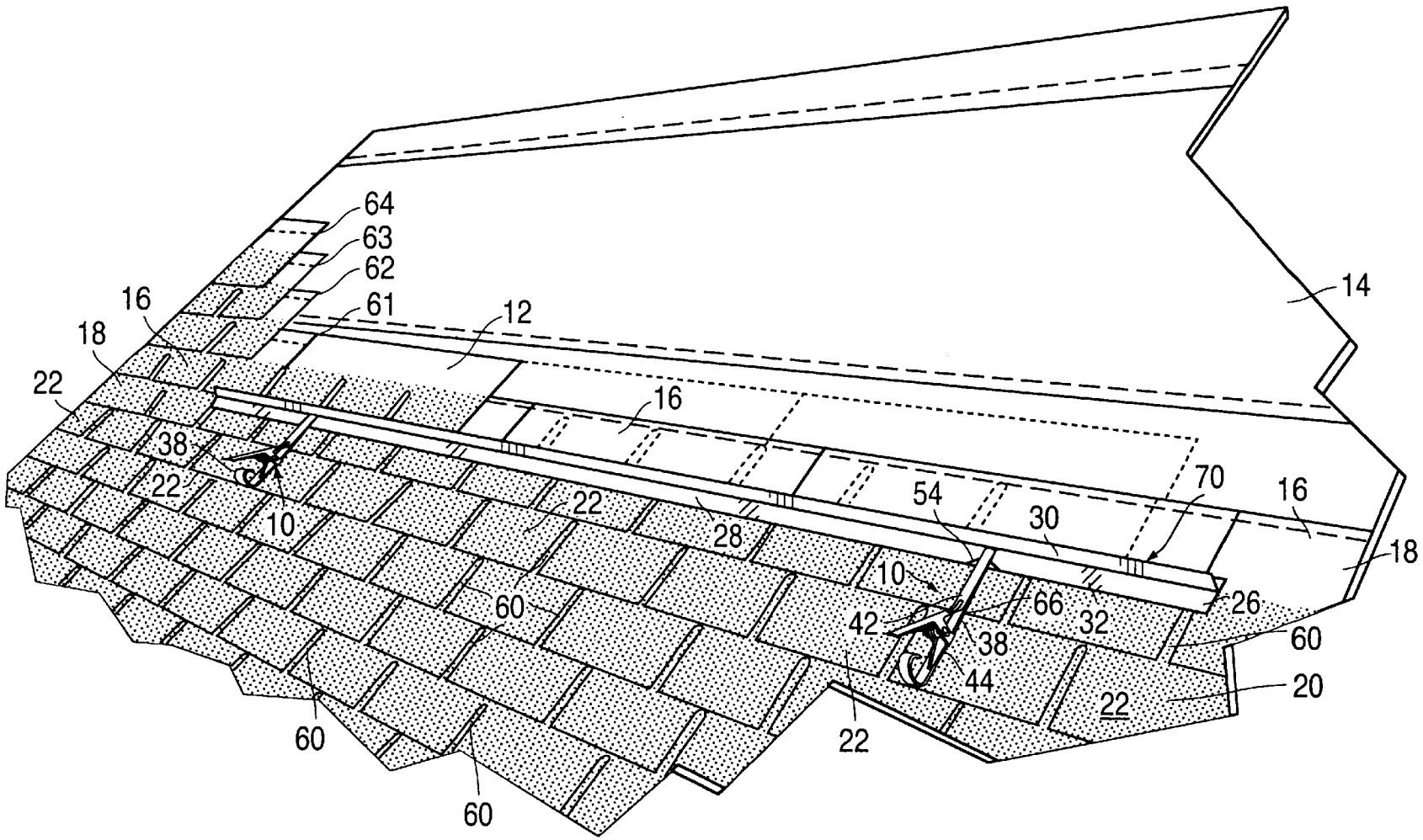
FIG. 6 (PRIOR ART)
FIG. 6 illustrates the conventional apparatus of FIG. 5 attached onto a roof of a structure.
Figure 7:
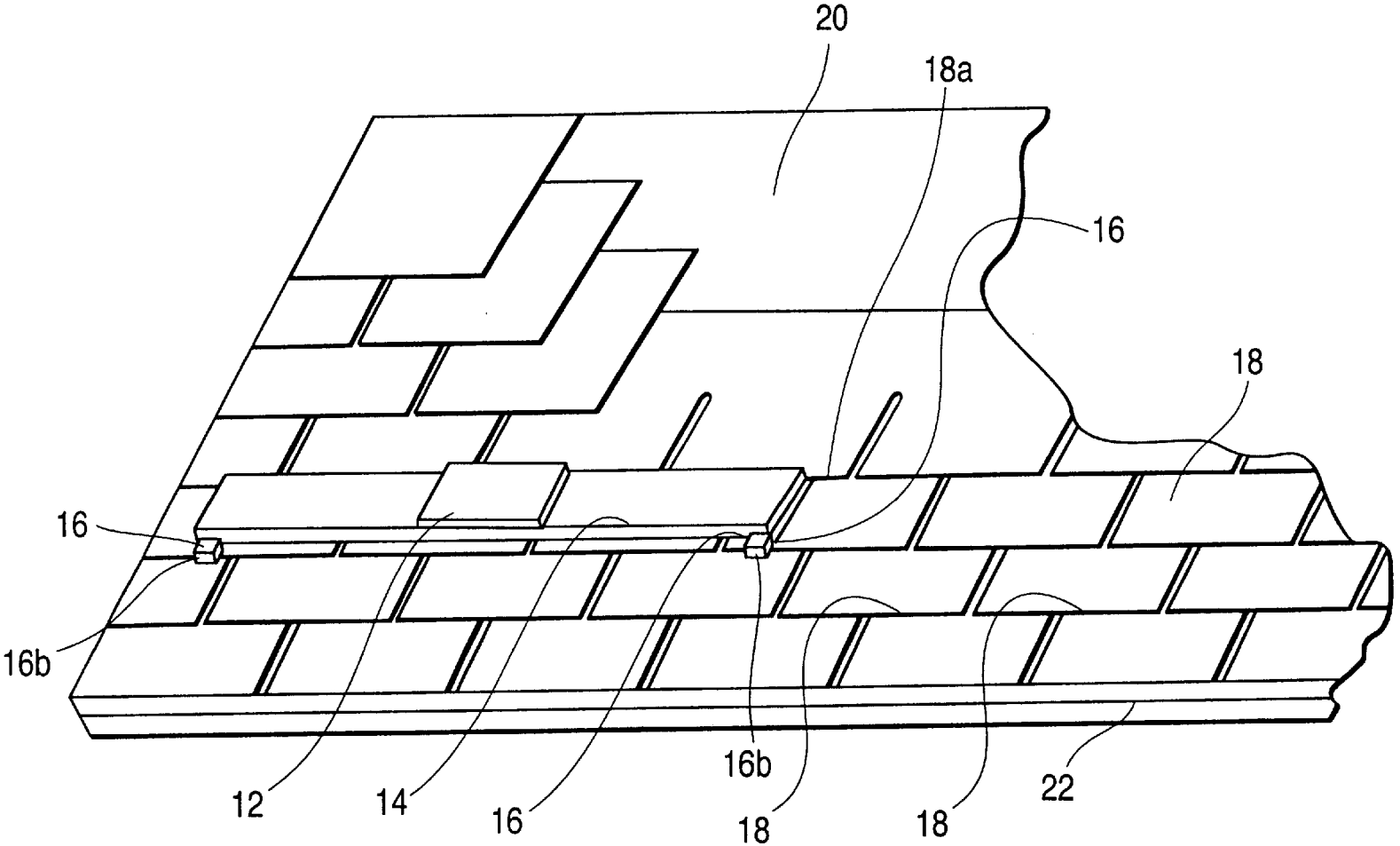
FIG. 7 (PRIOR ART)
FIG. 7 illustrates still another conventional apparatus for attaching shingles onto a roof of a structure.
Figure 8:
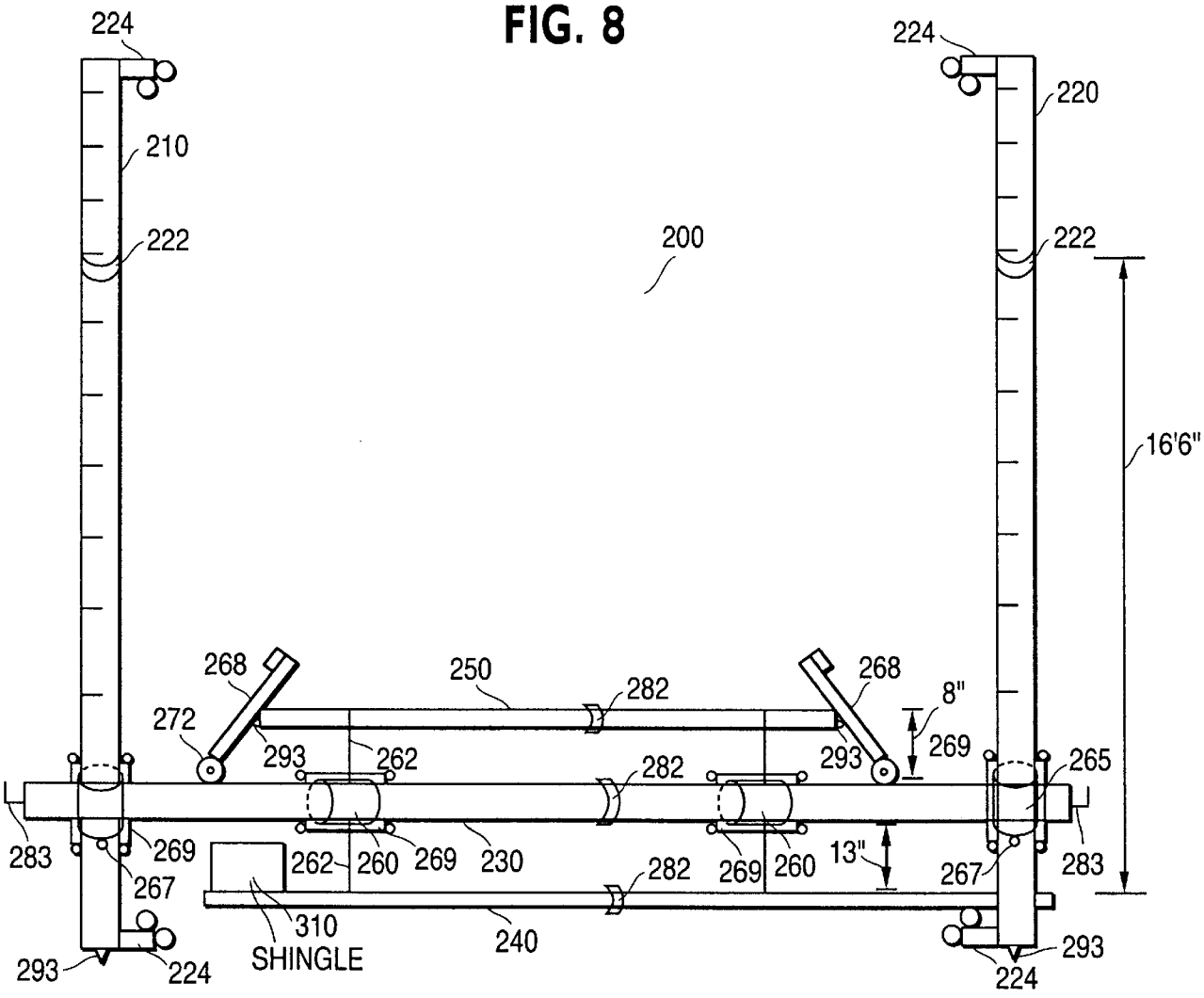
FIG. 8 illustrates an apparatus for laying shingles onto a roof according to a first embodiment of the invention.

Preferred embodiments of the invention will be described hereinbelow with reference to FIGS. 8 through 14. Referring now to FIG. 8, the apparatus 200 according to the invention includes a first end rail 210 that can be either retracted or extended, a second end rail 220 that is mounted approximately parallel to the first end rail 210 and which can also be either retracted or extended. In the present invention, the first and second end rails 210, 220 are constructed from a lightweight material, such as aluminum or plastic. In the present invention, the first and second end rails 210, 220 are retractable to a length of about 19 feet, and are extendable up a maximum length of about 32 feet. That way, when fully extended, an entire side of a standard residential roof can be installed using the apparatus according to the invention. Of course, other minimum/maximum lengths can be utilized while remaining within the scope of the invention.

Each of the first and second rails 210, 220 have slots positioned approximately 5" apart from each other, with the first slot being approximately 11½" from one end of each rail 210, 220. Of course, other distances can be envisioned while remaining within the teachings of the invention. These slots correspond to the standard distances that each row of shingles should be placed onto a roof. In the preferred embodiments, each of the first and second rails 210, 220 have hook and nail flanges 224 nearby their respective top and bottom ends so as to allow one to temporarily fasten the apparatus 200 to the roof. This fastening may be accomplished by nailing the apparatus 200 onto the roof, in a position such as that shown in FIG. 8. Other types of methods of temporarily attaching the apparatus 200 to the roof may also be utilized while remaining within the scope of the invention, as is known to one of ordinary skill in the art. Flanges 224 also provide a base for the first and second rails 210, 220 and to adhere the first and second rails 210, 220 to the roof. Due to the flanges 224, the first and second rails 210, 220 sit approximately 1" above the surface elevation of the roof on which the apparatus 200 is disposed.

The apparatus 200 also includes a third component situated between the first and second rails 210, 220. The third component includes a rail 230 (either aluminum or plastic) that is configured to rest onto a slot on the first rail 210 and a corresponding slot on the second rail 220. The third component also includes a fourth rail 240 and a fifth rail 250 which are each positioned substantially parallel with respect to the third rail 230, and which do not rest on any slots of the first or second rails 210, 220. For that matter, the fourth and fifth rails 240, 250 do not come into contact with the first and second rails 210, 220.

The third rail 230 is connected via hinges 265 to the first and second rails 210, 220. The hinges 265 allow for movement of the third rail 230 to rest on any particular location (i.e., marking) on the first and second rails 210, 220. The hinges 265 includes rollers 269 on their undersides (that is, the side facing the roof), so as to help carry the load of the third, fourth and fifth rails 230, 240 and 250. The third, fourth and fifth rails 230, 240 and 250 move together as a "rack" configuration, between the first and second rails 210, 220. The hinges 265 each have a spring loaded ball bearing (or bearings) 267, which is used to secure locking of the rack at a particular 5" mark on the first and second rails 210, 220. The ball bearing 267 is preferably located at a position which corresponds to a top of where a shingle lies, when the shingle is placed on the fourth rail 240.

The fourth and fifth rails 240, 250 are hingedly connected to the third rail 230. Hinges 260 and tension springs 262 are used to provide the connection of the fourth and fifth rails 240, 250 to the third rail 230, so that the fourth and fifth rails 240, 250 move in a tandem manner (i.e., in unison). That is, when a shift handle 268 is engaged, the fourth and fifth rails 240, 250 are moved 6" laterally with respect to their previous locations, so as to provide the proper placement of a row of shingles onto a previously-applied row of shingles. The shift handle 268 is connected via a pin 272 onto the third rail 230.

Due to the flanges 224, the first and second rails 210, 200 are disposed about 1" above the surface of the roof. Within this 1" clearance, the fourth and fifth rails 240, 250 can slide within, without coming into contact with either the surface of the roof or the first or second rails 210, 220. In other words, the fourth and fifth rails 240, 250 are disposed closer to the surface of the roof than the first and second rails 210, 220, so that shingles placed on the fourth rail 240 lay flat.

The hinges 265 are sized such that they can readily slide over any portion of the first and second rails 210, 220, even the twist joints 222. Thus, the diameter of the hinges 265 is greater than the diameter of the twist joints 222. The same is true of the hinges 260 and the twist joints 282, with the hinges 260 being sized so that they readily slide over the joints 282.

The shift handle 268 is shown as being attached at each end of the fifth rail 250. When the shift handle 268 is engaged by an operator, the hinges 260 and tension springs 262 allow for sliding movement of the fourth and fifth rails 240, 250 with respect to the stationary third rail 230. The shift handle 268 may provide for lateral movement of the fourth and fifth rails 240, 250 in any of a number of ways, such as by a gearing mechanism.

Alternatively, a shift handle may not be required when pneumatic pressure is used to move the rails. As shown in FIG. 8, the first and second rails 210, 220 each have an air hose connector 293, which is used to receive air-under-pressure from a generator or the like. When the first and second rails are filled with pressurized air, movement of the rack (that is, the third, fourth and fifth rails 230, 240 and 250) to a desired position can be effected by actuation of a button (not shown) on the apparatus 200. The button is preferably located on the rack. Once the button is actuated, the rack will slide over 6". With this configuration, each rail will have respective air valves (not shown) in an interior region thereof, to provide the necessary pressure release to cause a desired movement of the rack. Additionally, upon actuation of another button (not shown) on the apparatus 200, the rack can be made to move to the next higher marking on the first and second rails 210, 220. Preferably, the two buttons are located near each other. Thus, the pressurized air is configured to be able to travel in a circular motion throughout the first, second and third rails 210, 220 and 230.

The third, fourth and fifth rails 230, 240 and 250 are also configured to be retractable and extendable, and have locking joints 282 so as to allow for placement of the apparatus 200 onto any size of roof. The rails 210, 220, 230, 240 and 250 can be alternatively configured as telescoping rails, or other types of rails so as to allow for proper configuration of the apparatus 200 to suit a particular roof onto which shingles are to be laid. Twist lock joints 222 are disposed on the first and second rails 210, 220, allowing for setting of a desired length of the first and second rails to suit a particular sized roof.

In the present invention, the first end rail 210 includes a first section having a length of 16' 6". The first section is shown as the part of the first end rail 210 that is located below the twist lock joint 222 shown on the first end rail 210 of FIG. 8. The first end rail 210 also includes a second section, which is shown as the part of the first end rail that is located above the twist lock joint 222 shown on the first end rail 210 of FIG. 8. In the fully retracted position, the first end rail has a length of 19' 9", and so the second section extends out 3' from the end of the first section. In the fully extended position, the first end rail has a length of 32', and so the second section extends out 15' 6" (its full length) from the end of the first section. The second end rail 220 is configured similarly to the first end rail 210, with its own first and second sections.

Standard shingle sheets are 12" wide, and so by laying a row of shingles 6" staggered from an adjacent row of shingles, a proper laying of shingles is accomplished.

Each operation of the handle pin 260 allows for a 6" lateral movement of the fourth and fifth rails 240, 250. Note that a shift handle can be disposed on either or both sides of the fifth rail 250, so as to lessen the amount of movement required by a roofer to reposition the apparatus on the roof. For example, if the roofer happens to be closer to the first rail 210 when finished laying a row of shingles on the roof using the apparatus 200, the roofer would then walk over to engage the shift handle closest to the first rail 210.

The attachment of shingles onto a roof will now be explained in detail. First, the roofer lays out the apparatus 200 onto a side of the roof, similar to the layout shown in FIG. 8. Once the rails 210, 220, 230, 240 and 250 have been either extended or retracted so as to cover the entire dimensions of the roof, the rails 210, 220, 230, 240 and 250 are locked into place, such as by any conventional means. For example, the rails may be configured such that a simple twisting of the parts of each rail may be utilized to lock each rail in place. Next, the ends of the first and second rails 210, 220 are nailed onto the edges of the roof, using the hook and nail flanges 224.

Then, the third rail 230 is placed onto the lowermost slots on the first and second rails 210, 220. These lowermost slots are preferably positioned about 11½" above a lower end of the rails 210, 220. The lower end of the rails 210, 220 is nailed to the portion of the roof closest to the drip edge of the roof. Once the third rail 230 is placed onto the respective lowermost slots of the first and second rails 210, 220, the shift handle 268 is operated so as to allow for proper placement of the first row of shingles onto the roof.

Figure 9A:
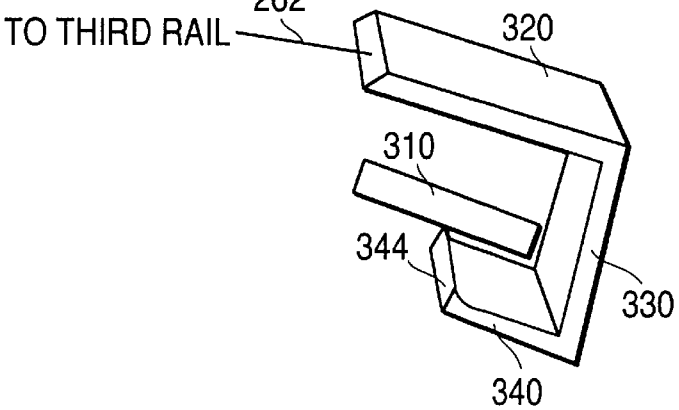
FIG. 9*a* illustrates a plan view of a first configuration of a bottom rail of the apparatus for laying shingles onto a roof according to the first embodiment of the invention.
Figure 9B:
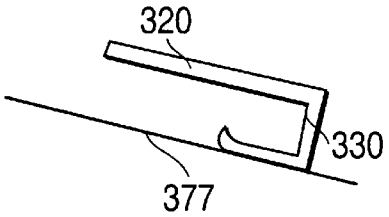
FIG. 9*b* illustrates a side view of the first configuration of the bottom rail according to the first embodiment of the invention.

Referring now to FIGS. 9*a* and 9*b*, which respectively show a plan view and a side view of the fourth rail 240 according to a first configuration of the first embodiment of the invention, the fourth rail 240 includes a bottom end for holding the shingles in place as the shingles are placed onto the roof 377. A shingle 310 is also shown in FIG. 9*a*.

A portion of the bottom end fits under a shingle that is placed on the apparatus 200. The fourth rail 240 is preferably configured to have about a 3" long top portion 320 that is substantially parallel to the plane of the roof, a ½" long side portion 330 that is substantially perpendicular to the plane of the roof, and about a ¼" lower portion 340 that rests on the roof. In the first configuration, the lower portion 340 is configured with a slightly curved lip 344, so as to easily fit under shingles placed onto the roof by a roofer.

Figure 9C:
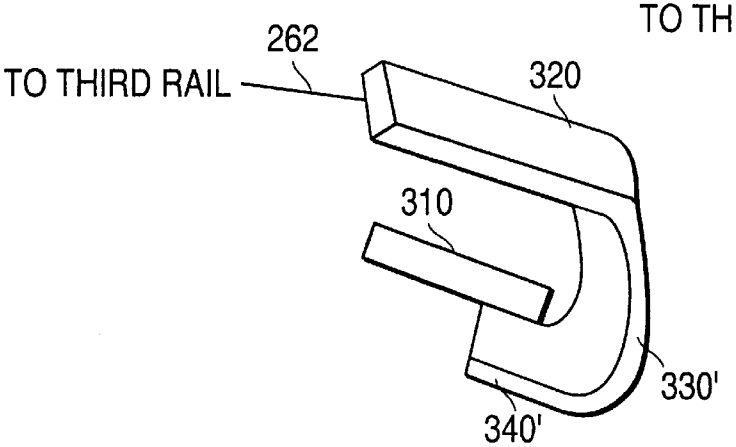
FIG. 9*c* illustrates a plan view of a second configuration of the bottom rail according to the first embodiment of the invention.

In a second configuration of the bottom end, as seen in FIG. 9*c*, the lower portion 340' is configured with a flat surface that rests entirely on the top (substantially flat) surface of the roof, as shown in FIG. 9*c*. Furthermore, in the second configuration with the straight lower portion 340', the side portion may either be straight or it could also be curved, so as to allow for ease in placement of the shingles onto the fourth rail 240. A curved side portion 330' and a straight lower portion 340' are shown in FIG. 9*c*.

Figure 9D:
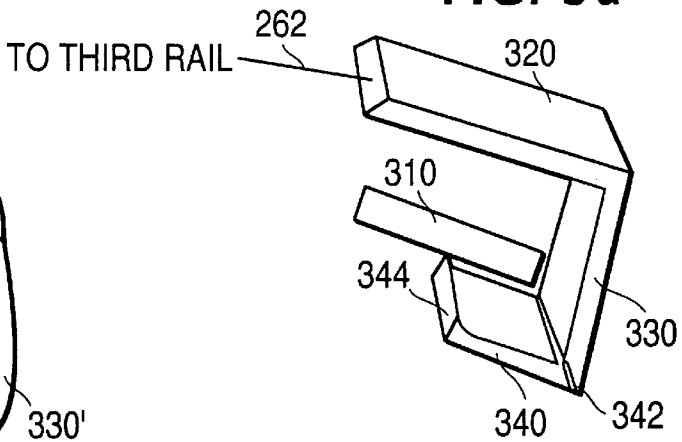
FIG. 9*d* illustrates a plan view of a third configuration of the bottom rail according to the third embodiment of the invention.

In a third configuration of the bottom end, the lower portion 340 may be hingedly attached to the side portion 330, so as to set the lower portion 340 at such an angle to the side portion 330 so as to rest the bottom portion 340 snug against all types of roofs, which may have varying angles of pitch. In the third configuration, as shown in FIG. 9*d*, once the lower portion 340 rests against the top surface of the roof at the same angle as the roof angle, a locking mechanism (not shown) would then be engaged to lock the hinge 342 in place and thereby maintain the angular setup between the lower portion 340 and the side portion 330 (and also the rest of the apparatus 200). Although the third configuration is shown having a curved bottom portion and a straight side portion, those portions can alternatively be curved or straight in any combination.

In the present invention, the fourth rail 240 is positioned apart from the third rail 230 by about 13". By this positioning, as a bottom part of a shingle is placed against the bottom portion 340 of the fourth rail 240, the top part of the shingle is positioned about 1" or so below the third rail 230 (since shingle sheets are typically about 12" high). This gives a space allowance for a roofer to properly fit the shingle onto the apparatus 200, which is especially useful in tight quarters. The fifth rail 250 is positioned apart from the third rail by about 8".

Once a shingle sheet has been placed onto the bottom portion of the fourth rail 240, a next shingle sheet may be abutted against an edge of the first shingle sheet, and so on. This is done without moving any part of the apparatus 200, which is different from any of the conventional apparatuses discussed earlier.

Once an entire row of shingles has been placed against the bottom portion 340 of the fourth rail 240, the row of shingles may be attached to the roof, such as by stapling them using a staple gun.

Now, the next row of shingles may be properly placed onto the roof in a manner described hereinbelow. The handle pin 260 is operated so as to move the fourth and fifth rails 240, 250 approximately 6" in a direction either towards or away from the first and second rails 210, 220. The third rail 230 is then moved to the next lowest slot on the first rail 210 and the next lowest slot on the second rail 220, which are 5" above the respective lowermost slots on the rails 210, 220. Note that the third rail 230 may be moved prior to the operation of the handle pin 260. The movement of the third rail 230 may be readily accomplished by two roofers simultaneously, or by one roofer who first slides the third rail 230 onto the next slot of one of first and second rails 210, 220, and then walks over and slides the third rail 230 onto the next slot of the other of the first and second rails 210, 220. In any event, the movement of the apparatus 200 to allow for proper positioning of a next row of shingles is believed to be simpler than those of the conventional devices.

Once the third rail 230 is in place and the shift handle 268 has been operated, the next row of shingles may be laid onto the roof by placing them, one by one, against the bottom portion 240 of the fourth rail, in a manner similar to that described for the placement of the shingles for the first row. This procedure is continued until all of the shingles of the roof have been laid.

Figure 10B:
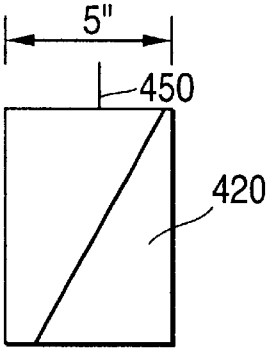
FIG. 10*b* illustrates a side view of the first device.
Figure 10A:
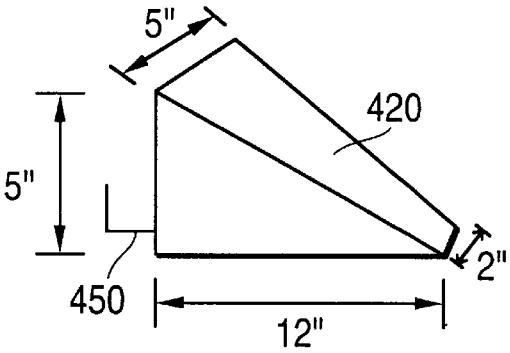
FIG. 10*a* illustrates a plan view of a first device which can be attached to the apparatus according to the invention.
Figure 11B:
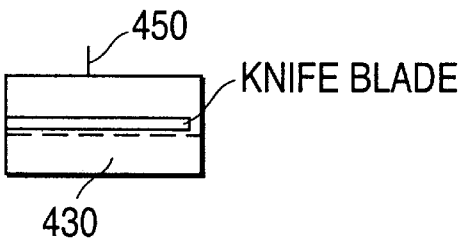
FIG. 11*b* illustrates a side view of the second device.
Figure 11A:
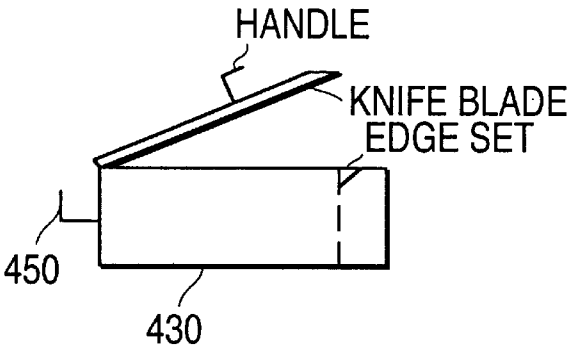
FIG. 11*a* illustrates a plan view of a second device which can be attached to the apparatus according to the invention.

In the first embodiment, each end of the third rail 230 is fitted with hooks 283, so as to allow for holding of various types of roofing devices thereon. Such devices are shown in FIGS. 10*a*, 10*b*, 11*a* and 11*b*, and include a tab lift 420 and an edge cutting tool 430. FIGS. 10*a* and 11*a* are plan views, and FIGS. 10*b* and 11*b* are side views. Each of these devices is equipped with a hook attachment 450, so as to be easily hooked onto the hooks 283 provided at the ends of the third rail 230.

Figure 12:
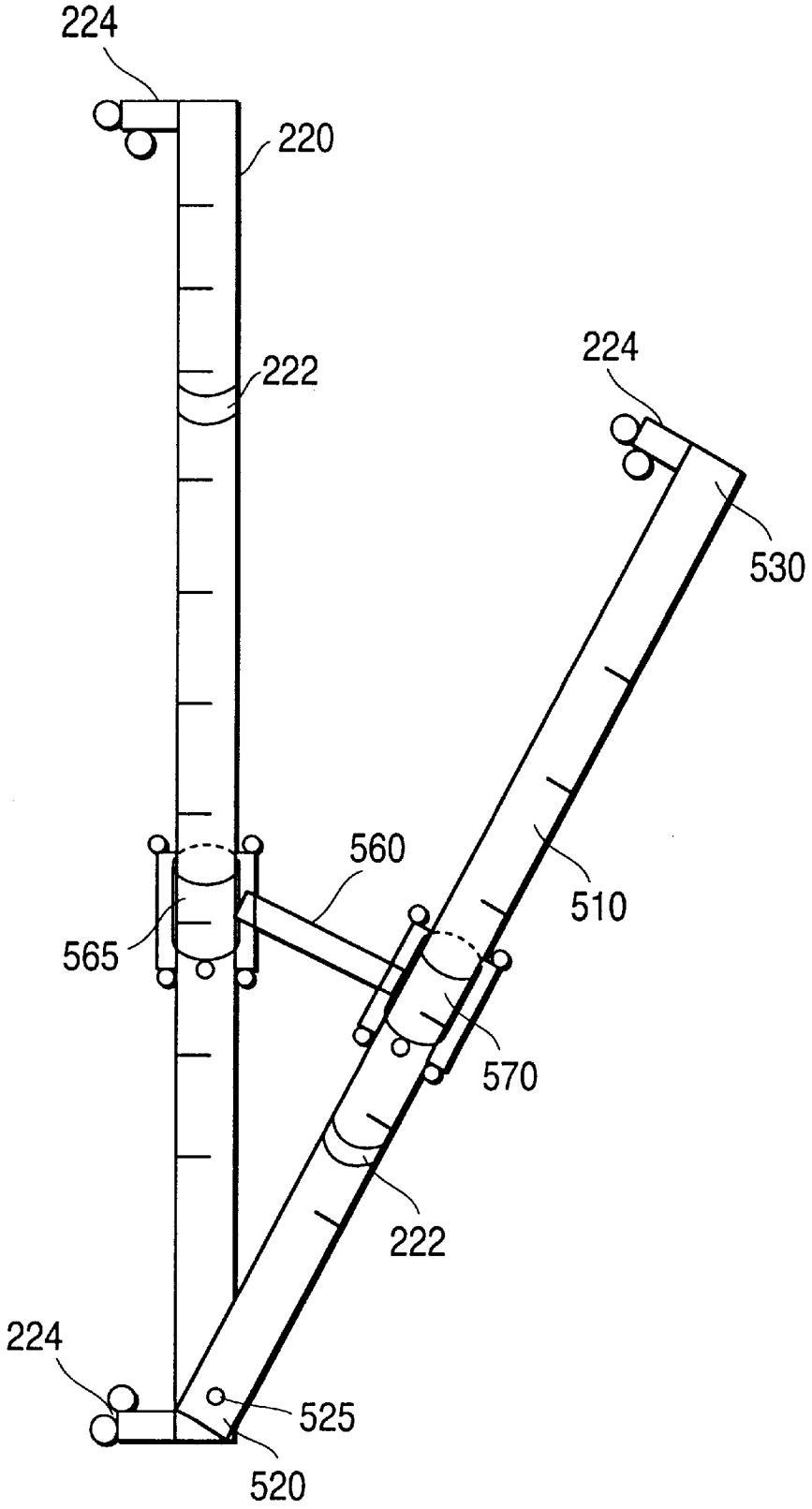
FIG. 12 illustrates an optional valley extension that can be used in accordance with the invention.

FIG. 12 shows another optional component of the apparatus according to the invention. In FIG. 12, a valley extension 510 is connected to the second rail 220. For simplicity, other components of the apparatus (see FIG. 8) are not shown. The valley extension 510 allows for the proper laying of shingles on a "valley" of a roof. A valley of a roof corresponds to a portion of a roof with its own slope, which is different from the slopes of other adjacent portions of the roof. Placement of shingles onto a valley of a roof is typically harder than the placement of shingles onto a rectangular side of a roof, but by using the apparatus 200 according to the invention, this can be made much easier as well.

One end 520 of the valley extension 510 is connected to an end of the second rail 220 by a swivel pin 525, so as to allow for the extension to be swung to any desired degree and height (with respect to a longitudinal axis of the second rail 220), so as to allow for the laying of shingles onto the valley. The arrow 528 shows the directions in which the valley extension can be moved.

Like the second rail 220, the other end 530 of the valley extension 510 can be rigidly attached to the roof in a hook and nail flange 224, such as by hammering a nail through a hole through the hook and nail flange 224 and into the roof. Valley extension 510 is also connected to the second rail 220 by at least one retractable and expandable attachment 560. Attachment 560 has a swivel pin 565 at one end thereof, which pivotally connects the attachment 560 to the second rail 220. Attachment 560 has another swivel pin 570 at another end thereof, which pivotally connects the attachment 560 to the valley extension 510. Attachment 560 provides additional support for the valley extension 510. Also, like the first and second rails 210, 220, the extension 510 has 5" slots adjacently placed thereon, for proper laying of each row of shingles onto the valley portion of the roof.

The swivel pins 560, 565 of the attachment 560 can be locked in place at any location on the second rail 220 and the valley extension 510, so as to maintain a rigid angular setup of the second rail 220 and the valley extension 510. Also, the attachment 560 can also be locked in place so as to fix its length, which can be done by twisting two telescopic portions of the attachment 560 together at twist lock joint 222 so as to lock them in place to maintain a desired length of the attachment 560. Of course, other types of ways of constructing the attachment 560 so as to allow for expansion and retraction, as well as to allow for ease in setting a particular length of the attachment 560, can be envisioned by one of ordinary skill in the art while staying within the teachings of the invention as described herein.

Further, a seventh and an eight rail (not shown) are connected to the attachment 560 by hinges and tension springs, in a manner similar to that of the fourth and fifth rails 240, 250 being hingedly connected to the third rail 230 in FIG. 8.

Although FIG. 12 only shows the valley extension 510 being connected to the second rail, another valley extension may also be used, which would be connected to the first rail 210 in a same manner as the valley extension 510 is connected to the second rail 220 in FIG. 12.

Figure 13:
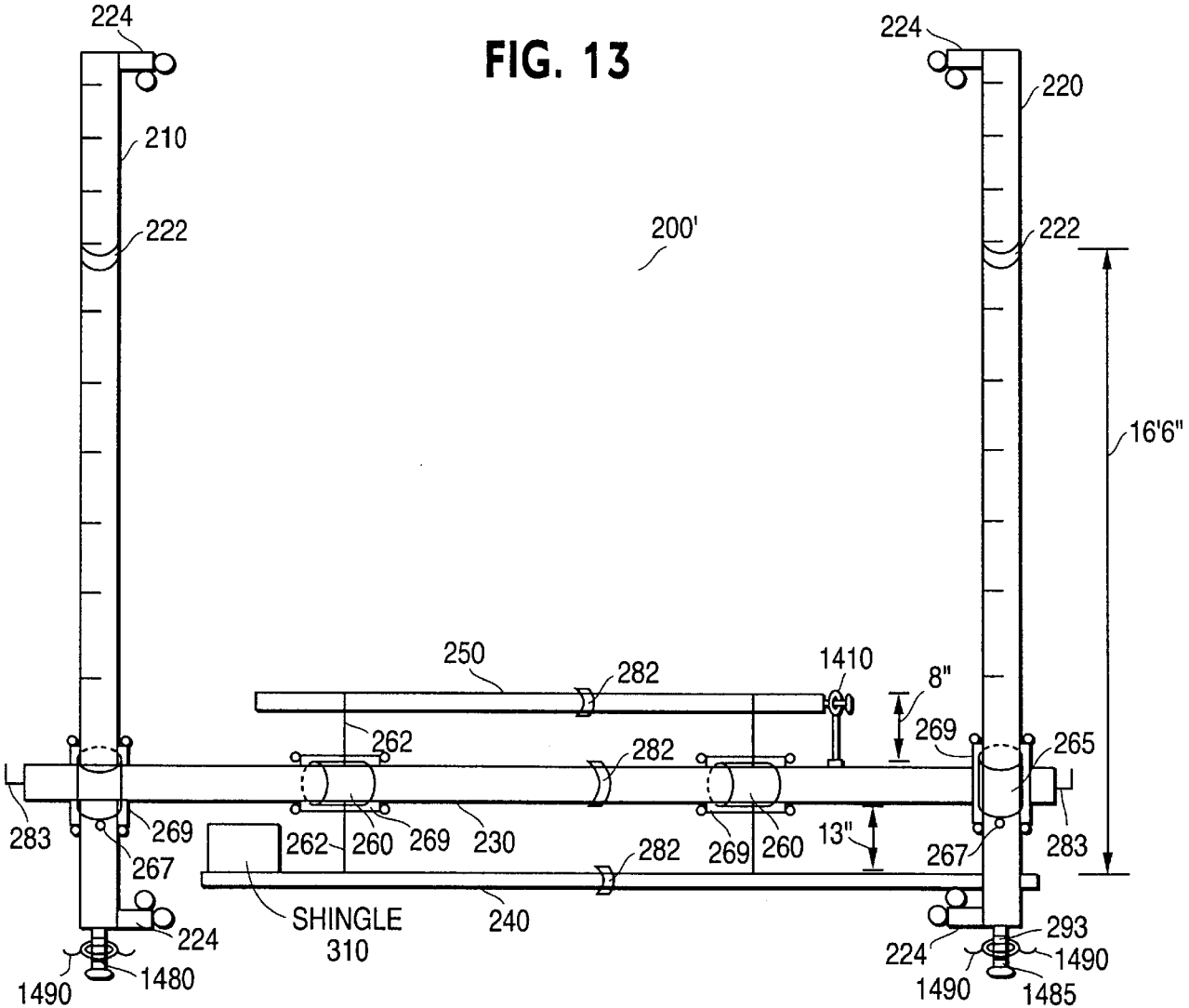
FIG. 13 illustrates an apparatus for laying shingles onto a roof according to a second embodiment of the invention.

FIG. 13 shows a second embodiment of an apparatus 1300 for laying shingles onto a roof according to the invention. The structure of FIG. 13 is similar to that of the first embodiment shown in FIG. 8, with like numbers indicating similar components. In the second embodiment, instead of using a handle at one or both ends of the fifth rail 250, a double-action adjusting mechanism 1410 is provided at one end of the fifth rail 250.

Figure 14:
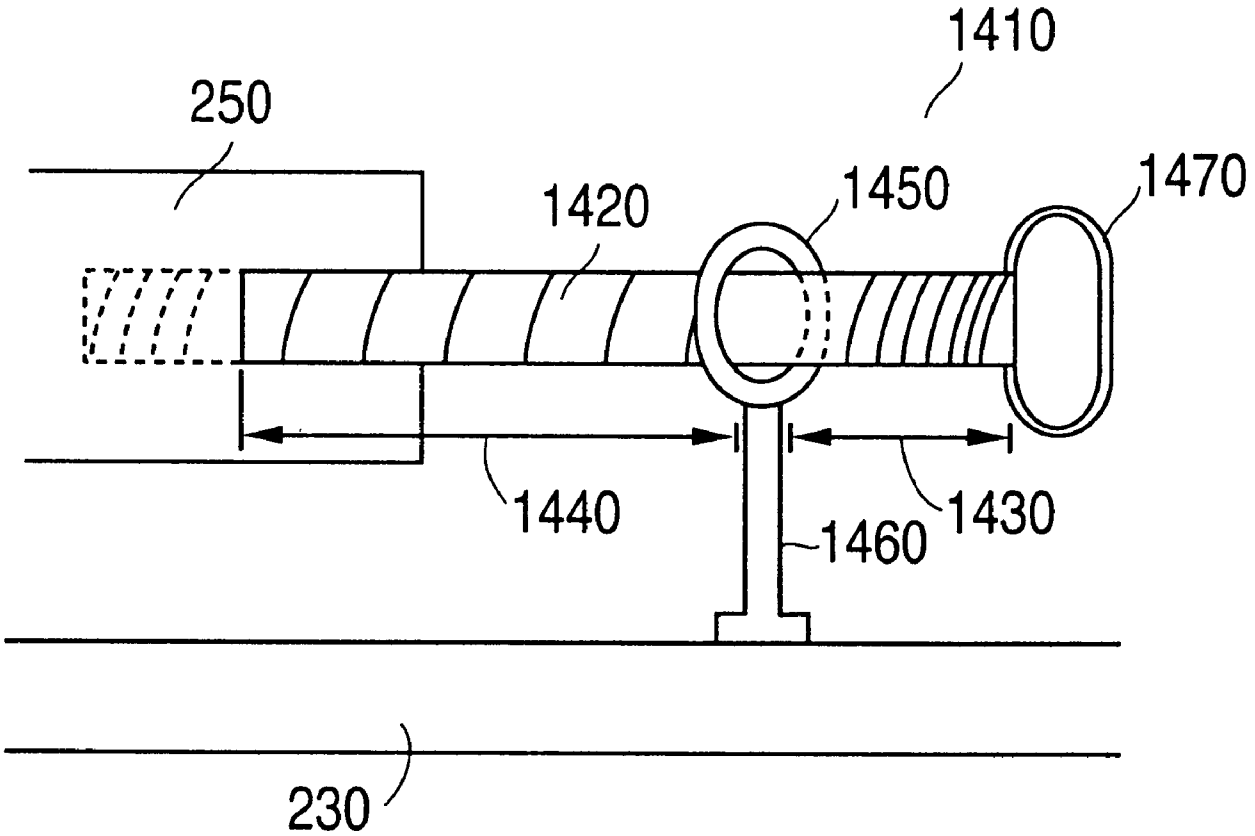
FIG. 14 illustrates a double-action theaded device used in the second embodiment of the invention.

FIG. 14 shows the structure of the double-action adjusting mechanism 1410 in more detail. Mechanism 1410 provides for 6" lateral movement of the fourth and fifth rails 240, 250, but in a different way then that performed by operating the handle pin 268 according to the first embodiment. Double-action adjusting mechanism 1410 includes a threaded bearing or bolt 1420, which includes a first region 1430 which is threaded at a fine (or narrow) threading width, and which includes a second region 1440 which is threaded at a wide threading width. The threads provide a continuous path on the outer circumference of the bearing 1420, so that the end of the fine threading region is provided right against the start of the wide threading region. The threaded bearing 1420 is adapted to be inserted into one end of the fifth rail 250, with that end of the fifth rail 250 having a opening that is threaded to receive the wide threaded portion of the bearing 1420. The opening is sized based on the size (diameter) of the bearing 1420, such that the bearing 1420 can be properly threaded into the opening.

Mechanism 1410 also includes a stationary threaded bearing 1420, which is sized to receive the threads from the first region 1430. A bottom stand portion 1460 extends downward from the stationary threaded bolt 1450, and is sized so that the stand portion 1460 fits snugly against the rail 230. A handle or knob 1470 is provided at one end of the threaded bearing 1420. When the knob 1470 is turned one complete revolution when the other end of the threaded bearing 1420 is fitted into the opening of the fifth rail 250, the threaded bearing 1420 is screwed into the opening of the fifth rail 250 such that the knob 1470 abuts against the stationary threaded bolt 1450.

During this turning of the knob 1470, the stationary threaded bolt 1450 remains fixed in position due to its being snugly positioned against the rail 230 by virtue of the stand portion 1460. Meanwhile, the threaded bearing 1420 threads its way through the stationary threaded bolt 1450 and into the opening within the fifth rail 250. The distance between the knob 1470 and the stationary threaded bearing 1450, when the threaded bearing 1420 is barely threaded into the opening of the fifth rail 250, is about 3" in the present invention. Due to the larger-sized threads in the second region of the threaded bearing 1420 that makes its way into the opening of the fifth rail (having equally larger-sized threads), the 3" movement of the knob 1470 results in a larger movement of the fourth and fifth rails 240, 250 with respect to the rail 230.

In the present invention, the tracks making up the wider threads are about three times the width as the tracks making up the narrow threads, and a 3" movement of the knob 1470 to be positioned against the stationary threaded bearing 1450 results in a 6" movement of the fourth and fifth rails 240, 250, which is the desired amount of movement. The distance between the stationary threaded bearing 1450 and the end of the rail 230 is set to 1" in the present invention. Of course, the distances and the thread ratios between the first and second regions can be set to whatever is required to obtain an approximate 6" movement of the fourth and fifth rails 240, 250 for one turn of the knob 1470.

Once the rails 240, 250 have been moved 6" and the roofer has laid down the shingles, the roofer may then move the knob 1470 back in the other direction one complete revolution, so that the fourth and fifth rails 240, 250 are back to their initial position. This back and forth movement is continued as the roofer places the shingles on the roof, a row at a time.

The adjusting mechanism 1410 is called "double action" since one turn in the clockwise (or counterclockwise) direction of the threaded bearing 1420 results in an opposite movement of the device in which the threaded bearing 1420 is being threaded into. Thus, due to the double-action capability of the mechanism 1410 with threads of different track widths for different portions of the threaded bearing 1420, a 6" lateral movement of the fourth and fifth rails 240, 250 can be accomplished without having a commensurate 6" long adjusting mechanism 1410. Rather, the adjusting mechanism can be smaller, say, 4" or so, to provide for the necessary lateral movement of the fourth and fifth rails 240, 250.

In a similar manner, double-action mechanisms 1480, 1485 are respectively provided at one end of the first and second rails 210, 220. As shown in FIG. 13, the double-action mechanisms 1480, 1485 are each provided stationary threaded bearings each having two hooks 1490, where the hooks 1490 replace the stand portion 1460 of the stationary threaded bearing 1450 used for the 6" lateral movement of the fourth and fifth rails 240, 250. Double-action mechanisms 1480, 1485 provide for fine tuning the positioning of the ends of the first and second rails 210, 220 to provide for leveled placement of those rails with respect to each other. Unlike the double-action mechanism 1410 for providing 6" lateral movement of the fourth and fifth rails 240, 250 for one complete turn of a knob, the double-action mechanisms 1480, 1485 can be turned to whatever amount desired (¼ turn, ½ turn, etc.) so that the rails 220, 230 (more particular, the markings on the rails) are lined up. Alternatively, a leveler (not shown) may be disposed on either the fourth rail 240 or the fifth rail 250, so as to provide an indication as to whether the apparatus according to the invention has been placed properly onto a roof.

The hooks 1490 are configured to engage the drip edge of the roof when the threaded bearing of the double-action mechanisms 1480, 1485 are threaded into threaded openings at the respective ends of the first and second rails 210, 220. When the hooks engage the drip edge, threading of one or both of the mechanisms 1480, 1485 will cause up or down (depending on direction of turning) movement of the first and second rails 210, 220. For example, if the first rail 210 needs to be moved about ½" upwards with respect to the second rail 220, then the mechanism 1480 coupled to the first rail 210 is threaded into the first rail 210 to a depth so as to provide for the required upwards movement of the first rail 210.

Once the proper leveling has been made (which may be confirmed by looking at the optional leveler disposed on either the fourth rail 240 or the fifth rail 250), the roofer can then start placing shingles onto the roof using the apparatus according to the invention. Before the fine tuning is to be performed using either or both of the double-action mechanisms 1480, 1490, the first and second rails 210, 220 are first adhered to the roof by way of the fasteners 224. After the double-action mechanisms 1480, 1485 are operated to obtain a level system, they are left in place, and the roofer is then able to place shingles onto the roof using the apparatus, without having the apparatus move out of alignment.

While embodiments have been described herein, modification of the described embodiments may become apparent to those of ordinary skill in the art, following the teachings of the invention, without departing from the scope of the invention as set forth in the appended claims. For example, while the second embodiment is shown with only one threaded bearing on one side of the fifth rail 250, another bearing can be provided on the other side of the fifth rail 250, to thereby allow a roofer to operate the bearing that is closest to him or her when the roofer is laying shingles onto a roof.

What is claimed is:

1. An apparatus for placement of shingles onto a roof, comprising:

a first retractable and extendible pole having markings at predetermined intervals on the pole, the markings being indicative of optimal placement of rows of shingles onto the roof;

a second retractable and extendible pole opposite the first retractable and extendible pole, the second retractable and expandable pole also having markings that are indicative of the optimal placement of the rows of shingles onto the roof;

a third retractable and extendible pole hingedly connected to the first pole at a first end of the third pole, and hingedly connected to the second pole at a second end of the third pole, wherein the third pole is disposed approximately perpendicular to the first and second poles;

means for moving the third pole to any one of the markings on the first and second poles;

a fourth pole positioned approximately parallel to the third pole, wherein the fourth pole includes a bottom portion for holding one of the rows of shingles as the one row of shingles are placed onto the roof; and means for slidably connecting the fourth pole to the third pole, wherein the fourth pole is moveable along a direction perpendicular to the first and second poles so as to move the one row of shingles in the direction perpendicular to the first and second poles.

2. The apparatus as recited in claim 1, further comprising:

a fifth pole positioned approximately parallel to the third and fourth poles, wherein the third pole is positioned between the fourth and fifth poles.

3. The apparatus as recited in claim 2, wherein the fifth pole is positioned at a distance apart from the fourth pole which is greater than a height of a standard shingle.

4. The apparatus as recited in claim 1, wherein the bottom portion includes:

a top region that is positioned approximately parallel with a plane of the roof when the apparatus is placed on the roof;

a middle region that is positioned approximately perpendicular with the plane of the roof when the apparatus is placed on the roof; and a bottom region that is positioned approximately parallel with the plane of the roof and which rests on the roof when the apparatus is placed on the roof, wherein a portion of the one row of shingles are placed onto the roof by placing the shingles so that the shingles rest on a top surface of the bottom region.

5. An apparatus for placement of shingles onto a roof, comprising:

a first pole;

a second pole disposed in a substantially parallel relationship with respect to the first pole;

a rack disposed in a substantially perpendicular relationship with respect to the first and second poles, with a first end of the rack resting on the first pole, and with a second end of the rack resting on the second pole, wherein the rack includes a tab portion for holding the singles as the shingles are placed on the roof.

6. The apparatus as recited in claim 5, wherein the first and second poles have markings at respective locations on the first and second poles, and wherein the rack is capable of being placed on one of the respective markings on the first and second poles to allow for proper placement of a row of shingles on the roof with respect to an adjacent row of shingles already placed on the roof.

7. The apparatus as recited in claim 5, wherein the rack comprises:

a third pole hingedly connected to the first pole at a first end of the third pole, and hingedly connected to the second pole at a second end of the third pole, wherein the third pole is disposed approximately perpendicular to the first and second poles; and a fourth pole positioned approximately parallel to the third pole, wherein the fourth pole includes a bottom portion for holding shingles as the shingles are placed onto the roof.

8. The apparatus as recited in claim 5, further comprising pneumatic means for causing pneumatic movement of the rack to a particular location on the first and second poles.

9. An apparatus for placement of shingles onto a roof, comprising:

a first extendable pole;

a second extendable pole disposed in a substantially parallel relationship with respect to the first extendable pole; and a third extendable pole coupled to the first and second poles and configured to hold shingles to be placed onto the roof, wherein the third pole includes a mechanism for moving the third pole in a lateral direction.

10. The apparatus as recited in claim 9, wherein the mechanism is one of a double-action threaded bearing and a handle pin.

* * * * *